United States Patent [19]

Morita

[11] Patent Number: 4,700,436

[45] Date of Patent: Oct. 20, 1987

[54] MAGNETIC FASTENER

[76] Inventor: Tamao Morita, 47-1, Arakawa 6-Chome, Arakawa-ku, Tokyo, Japan

[21] Appl. No.: 836,537

[22] Filed: Mar. 5, 1986

[30] Foreign Application Priority Data

Mar. 7, 1985 [JP] Japan ..... 60-45260
Mar. 25, 1985 [JP] Japan ..... 60-58597

[51] Int. Cl.[4] ..... A44B 21/00; E05C 17/56

[52] U.S. Cl. ..... 24/303; 292/251.5; 252/519

[58] Field of Search ..... 24/303, 688, 49 M, 94; 292/251.5; 252/519; 248/206.5

[56] References Cited

U.S. PATENT DOCUMENTS

| | | | |
|---|---|---|---|
| 2,340,781 | 10/1940 | Wagner . | |
| 2,615,227 | 11/1949 | Hornik . | |
| 2,623,256 | 5/1950 | Feibelman . | |
| 2,726,110 | 12/1955 | Teetor | 292/251.5 |
| 3,100,663 | 8/1963 | Loeb | 292/251.5 |
| 3,159,372 | 12/1964 | McIntosh | 24/303 |
| 3,192,747 | 7/1965 | Stupell et al. | 292/251.5 |
| 3,324,521 | 6/1967 | Humiston . | |
| 3,897,288 | 7/1975 | Fayling | 24/303 |
| 4,021,891 | 5/1977 | Morita | 24/303 |
| 4,033,013 | 7/1977 | Peterson | 24/303 |
| 4,200,852 | 4/1980 | Aoki . | |
| 4,390,458 | 6/1983 | McKaveney | 252/519 |
| 4,438,164 | 3/1984 | Pfeifer et al. . | |
| 4,453,294 | 6/1984 | Morita | 24/303 |
| 4,455,719 | 6/1984 | Morita | 24/303 |
| 4,458,395 | 7/1984 | Aoki | 24/303 |
| 4,480,361 | 11/1984 | Morita | 24/303 |
| 4,556,611 | 12/1985 | Nakajima | 252/519 |
| 4,593,736 | 6/1986 | Morita . | |

FOREIGN PATENT DOCUMENTS

| | | |
|---|---|---|
| 1068149 | 10/1959 | Fed. Rep. of Germany . |
| 1127509 | 4/1962 | Fed. Rep. of Germany . |
| 1268582 | 6/1961 | France . |
| 47-16817 | 11/1972 | Japan . |
| 374845 | 3/1964 | Switzerland . |

*Primary Examiner*—Victor N. Sakran
*Attorney, Agent, or Firm*—Holman & Stern

[57] ABSTRACT

A magnetic fastener comprising a permanent magnet member having first and second sides of opposite polarity, a first magnetic pole plate attached at the first side of the magnet member, a second magnetic pole plate removably attachable on the second side of the magnet member, the pole plates being magnetically attracted to the magnet member and to each other through the magnet member, the permanent magnet member being a dispersion of hard magnetic powder in a matrix of synthetic resin, and the first magnetic pole plate being integrally attached to the permanent magnet member by the permanent magnet member itself. The permanent magnet member may be comprised of a molded member made by casting wherein the first magnetic pole plate is at least partly incorporated in the molded magnetic member or may be embedded therein. A hole is provided through the permanent magnet member extending between the first and second sides, and projections on the first and second pole plates extend into the hole so that the projections are magnetically attracted to each other and to the corresponding pole plate. The permanent magnet member being comprised of hard magnetic powder bound together by a synthetic resin and the first pole plate being incorporated as a part of the permanent magnet itself obviates the necessity for a protective covering or casing over the permanent magnet member and a reduction in the magnetic reluctance between the permanent magnet member and the first and second pole plates.

20 Claims, 30 Drawing Figures

MAGNETIC FASTENER

BACKGROUND OF THE INVENTION

1. Field of the Invention

The present invention relates to the utilization of permanent magnets made of hard magnetic powder of ferrite, alnico, rare-earth and the like materials solidified with synthetic resin and then magnetized. More particularly, it relates to an improvement is magnetic material fastener means made of permanent magnet which is provided with magnetic plates at its magnetic poles.

2. Description of the Prior Art

In the case of a magnetic fastener means, magnetic flux of a small size permanent magnet must be converged at each of the magnetic poles to obtain more intensified force of magnetism. For this purpose, a magnetic pole plate is attached to a magnetic pole. Since less expensive sintered magnets such as ferrite and alnico magnet are used for magnetic fastener means for economic reasons, they are likely to break and it was heretofore necessary to protect the peripheral surface of the magnet with a metal case.

Various improvements have been made on magnetic fastener means utilizing the magnetic force of a permanent magnet. The inventor made a magnetic fastener means substantially as shown in FIG. 30 utilizing the magnetic force of a permanent magnet 100. A magnetic pole plate 101, 102 each is attached to the N-S poles of the magnet 100 to converge the magnetic flux thereof at the pole plates 100 and 102 for effecting contact between ferromagnetic projections 101*a* and 102*a* provided on the pole plates 101 and 102, respectively. These improvements have been published as U.S. Pat. No. 4,012,891 and No. 4,453,294 issued in the name of this applicant.

The outstanding merit of Morita's improvements lies in that a hole 100*a* (FIG. 30) is provided directed toward the N-S poles of the magnet 100 so that the magnetic pole plate 102 of a female fastener member B' and the plate 101 of a male fastener member A' at the N-S poles respectively are made to contact at the projections 101*a* and 102*a* in said hole 100*a*.

As a result, the magnetic flux of the permanent magnet 100 is converged at the plates 101 and 102 at the N-S poles. At the same time a passage is constructed passing through the hole 100*a* which is considered magnetically neutral. The passage extending between the two poles has less magnetic reluctance. By contacting the male member A' and the female member B' of the magnetic fastener in said magnetic passage made in the hole 100*a*, these two members can be attracted strongly to each other.

In the magnetic fastener means according to applicants inventions in U.S. Pat. No. 4,012,891 and No. 4,453,294, it was necessary to provide a cover member 103 for protecting the magnet where magnetic pole plate 101 is attached as shown in FIG. 30 since the permanent magnet used in the fastener means was hard and brittle sintered magnetic material such as a ferrite magnet. The cover member 103 was also used to protect the magnet 100 from breaking.

Use of the cover member 103 for protecting the magnet 100 has a number of disadvantages one of which is that when the magnetic pole plate 102 is attached to the magnetic pole of the magnet 100 by the cover member 103, a small interstice X is formed between the plate 102 and the magnet 100, and the interstice X constitutes high reluctance zone to the passage of the magnetic.

The pole plate 101 of the male fastener member B' to be attracted by the female fastener member B' is in effect attracted by the magnetic pole of the magnet 100 via the cover member 103. Thus, there will be formed an additional interstice X' forming high magnetic reluctance.

However, it was not possible to omit the use of the cover member 103 in the conventional magnetic fasteners. Since the cover member 103 constituted a passage for magnetism communicating the magnetic pole plates 101 and 102 and since the cover member 103 was made of non-magnetic material for preventing the magnetic flux from leaking to outside the projections 101*a* and 102*a* (or the cover member 103), it was not possible to avoid the formation of interstice X' where magnetic reluctance occurs.

BRIEF SUMMARY OF THE INVENTION

In the present invention, the magnetic fastener means is made of magnetic material solidified with synthetic resin, the magnetic material itself being provided with a magnetic pole plate. In other words, the fastener means according to the present invention can be made more compact and less costly and yet has a stronger magnetic force as it no longer needs a case for attaching a pole plate nor a case for protecting the permanent magnet.

The present invention is an extension of the applicant's previous inventions and comprises a magnetic fastener made of synthetic resin having permanent magnetism and is characterized in that the male and female fastener members are so constructed that there is less magnetic reluctance between the magnet and the pole plates, a less magnetic reluctance passage (to prevent magnetic force from leaking to outside) is provided in the hole 100*a* of the permanent magnett 100 and the magnetic flux of the magnet 100 can be efficiently converged.

BRIEF DESCRIPTION OF THE DRAWINGS

The invention will now be described in greater detail with reference to the accompanying drawings wherein.

DETAILED DESCRIPTION

The permanent magnet 1 shown in FIGS. 1 through 29 is the type generally known as a plastic magnet. Although the term is not necessarily adequate, we shall use it for the convenience of explanation.

The plastic magnet is made of hard magnetic powder t—t (FIG. 3) such as powder of ferrite, alnico or rare-earth metals which is mixed with synthetic resin m in a weight ratio of about 90% powder, heated and molded before being magnetized.

Synthetic resins to be used in the present invention include, ideally, polyamide such as Nylon 66 or polyester. Other types of resins may also be used.

Although magnetic material in sheet form may be punched into a disk to obtain the permanent magnet 1, it is preferable to cast the material into a die to obtain a magnet with precise dimensions, or to enable a pole plate to be attached, which will be discussed later, or to form a skin layer on the surface.

The permanent magnet 1 thus formed is made of hard magnetic powder t—t bound with synthetic resin m. A skin layer m′ or synthetic resin is formed on the surface.

The above structure indicates that the powder t—t of the permanent magnet 1 is organically bound by the synthetic resin and that the skin layer m′ maintaining elasticity is formed on the surface.

Thus, the magnet 1 is advantageously resistant against impact while maintaining the magnetic capacity at a reasonable level.

Figure 1:
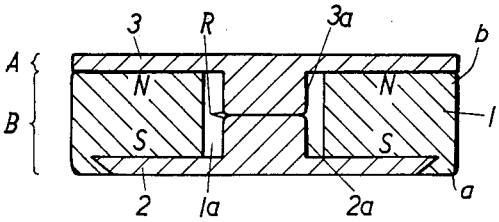
FIG. 1 is a cross-sectional view of one embodiment of the invention.
Figure 2:
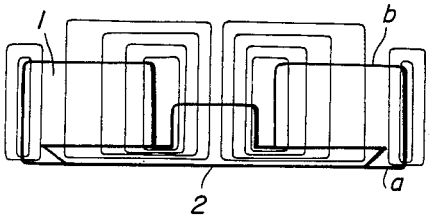
FIG. 2 is a schematic drawing of a part of FIG. 1 showing magnetic flux.
Figure 3:
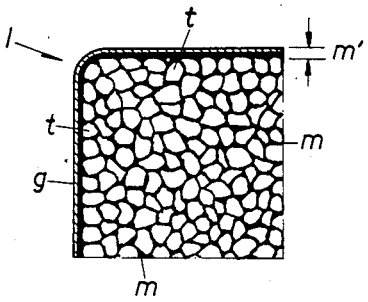
FIG. 3 is an enlarged partial cross-sectional view of the magnet of one embodiment of the invention showing the manner of construction thereof.

Specifically, the permanent magnet 1 is molded by casting, as shown in FIG. 1, with the ferromagnetic pole plate 2 being incorporated at one of the poles a at the time of casting. A hole 1*a* is bored at the center thereof extending between the N,S poles. A projection 2*a* of the plate 2 is provided to reach the midpoint of the hole 1*a* along its length.

The above construction constitutes the female fastener member, indicated by the letter B in the drawings. The male fastener member A comprises a ferromagnetic pole plate 3 to be attracted to the other pole b of the magnet 1, and a projection 3*a* to project from the pole plate 3 to come in contact with the projection 2*a* at a midpoint of the hole 1*a* along the length.

In the magnetic fastener of the above construction, the magnetic flux of the magnet 1 converges on the plate 2 at one of the poles a as well as one the plate 3 at the other pole b. Because of low magnetic reluctance of the thick identical projections 2*a* and 3*a* provided on the plates 2 and 3, the magnetic flux is induced in these parts to form a circuit connecting the magnet 1, plate 2, projection 2*a*, projection 3*a*, plate 3, magnet 1.

Figure 30:
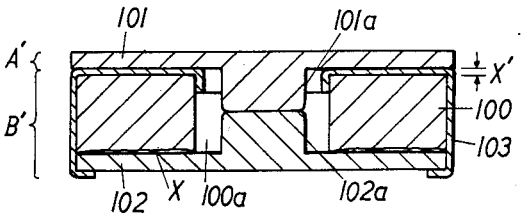
FIG. 30 is a view similar to FIG. 1 showing a prior art magnetic fastener of the applicant.

As the magnet 1 and the plate 2 are in complete contact with each other, there will be no magnetically void portion therebetween, such as shown at X in FIG. 30. There will be no such void between the plate 3 and the magnet 1 (as encountered in the conventional non-magnetic case at X′ in FIG. 30) either, so that there will be no magnetic reluctance occurring in the circuit.

In constructing the magnetic circuit as mentioned above, the area of contact between the projections 2*a* and 3*b* may be made smaller in the present invention. In other words, by rounding the top peripheral edge of the projections 2*a* and 3*a* with a curvature R, the contact area of the two can be reduced. This is effective in increasing the intensity of magnetic flux per unit contact area and thus increasing the attracting force.

Another feature of the present invention lies in that a plate layer g is provided on the magnet 1 to protect the skin layer m′. This is effective in improving the impact resistance as well as wear resistance.

Moreover, the skin layer m′ is indispensible in forming the plate layer g. That is, if the layer of the hard magnetic powder t—t is exposed on the surface without the skin layer m′, the plating solution would permeate inside, making it difficult to form a uniform coating on the surface. Moreover, the plating solution permeated inside may later errode the plated coating.

Figure 4:
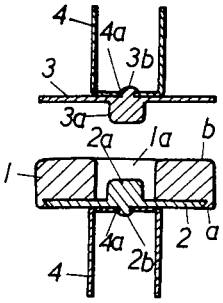
FIG. 4 is an exploded cross-sectional view of the embodiment of FIG. 1 showing one manner of making the fastener with an attaching member.

The fastener means shown in FIGS. 4 through 16 are the embodiments of the present invention as briefly described above. In FIG. 4, the plates 2 and 3 are formed integrally with the projections 2*a* and 3*a* respectively by means of a press machine. Moreover, very thin projections 2*b* and 3*b* are also provided for firm engagement. The projections 2*b* and 3*b* are inserted and pressed into a small hole 4*a* made in a U-shape attaching leg 4.

Figure 5:
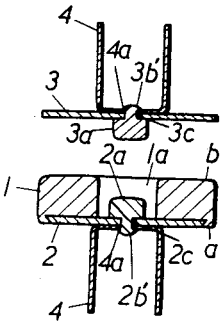
FIG. 5 is a view similar to FIG. 4 showing a further embodiment of the attaching member.

In the embodiment shown in FIG. 5, the plates 2 and 3 are formed separately of the projections 2*a* and 3*a*. Small catches 2*b*′ and 3*b*′ of the projections 2*a* and 3*a* respectively are inserted and pressed into small holes 2*c* and 3*c* of the plates 2 and 3 and a small hole 4*a* of the leg 4 for engagement.

Figure 6:
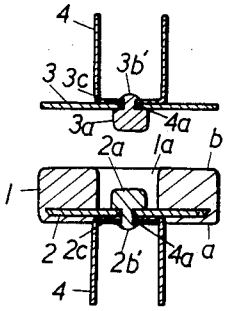
FIG. 6 is a view similar to FIG. 5 showing a different embodiment of the fastener.

In FIG. 6, the plate 2 is embedded inside the permanent magnet 1 at the pole a which prevents the plate 2 from slipping out of the magnet.

Figure 7:
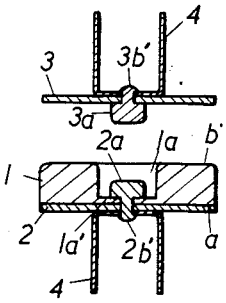
FIG. 7 is a view similar to FIG. 5 showing an additional embodiment of the fastener.

In FIG. 7, the hole 1*a* of the magnet is not a through-hole extending entirely through the magnet between the poles a and b. Instead, the plate 2 is attached to the leg 4 by means of a small catch 2*b*′ of the projection 2*a* penetrating through a fine hole through a thin portion 1*a*′ provided at the bottom of hole 1*a* of the magnet 1.

Figure 8:
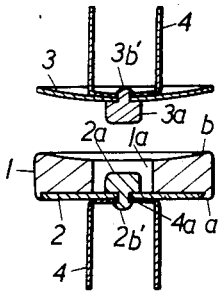
FIG. 8 is a view similar to FIG. 5 showing a further embodiment of the fastener.

In FIG. 8, the plane of the magnetic pole b of the magnet 1 is concaved in the direction of the hole 1*a* while the plate 3 is convexed on the adjoining surface. This facilitates slipping of the projection 3*a* into the hole 1*a* and formation of uniform plating on the concave surface.

Figure 9:
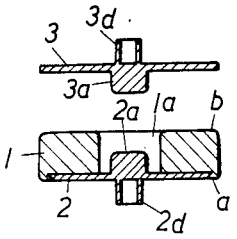
FIGS. 9, 10, 11 and 12 are similar to FIG. 1 showing different embodiments of the fastener of this invention.
Figure 10:
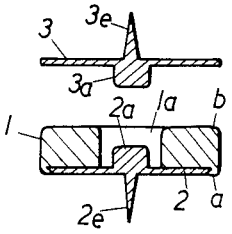
Figure 11:
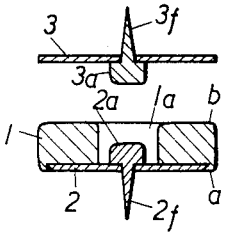
Figure 12:
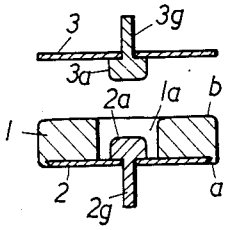

FIG. 9 shows a different means for attaching the male fastener member A and the female fastener member B to a handbag and the like without using the leg 4. Rod members 2*d* and 3*d* are formed on the plates 2, and 3, respectively. The rod members 2d and 3d are to be inserted in a hole made on the material of a handbag and the like and then pressed as in the case of eyelet. The rod members 2d and 3d shown in FIG. 10 are sharply projected at their tips 2e and 3e respectively, to be inserted in the slit of a washer which is prepared separately. The prongs 2e and 3e may be in the form of a bolt or a wood screw. In FIGS. 11 and 12, the plates 2, 3 are formed separately from the projections 2a and 3a. The thin rod tip or prong portions of the projections 2a and 3a form respective wood screws 2f and 3f and bolts 2g and 3g.

Figure 13:
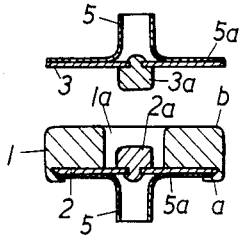
FIGS. 13 and 14 are views similar to FIG. 5 showing further embodiments of the invention.
Figure 14:
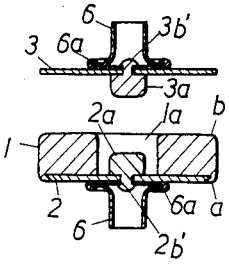

In FIG. 13, a tubular caulking means 5 has a collar 5a each attached to the plates 2 and 3 by molding or welding. In FIG. 14, a washer 6a is slipped over a tubular caulking means 6 of similar construction. Small catches 2b' and 3b' of the projections 2a and 3a are inserted in the hole of the washer 6a for press-engagement.

Figure 15:
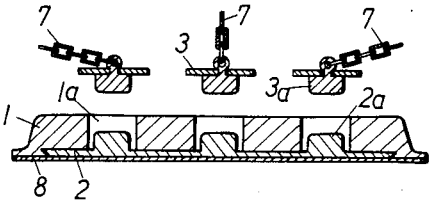
FIG. 15 is a cross-sectional view showing a different embodiment of the invention wherein a plurality of fasteners are integrated.

In FIG. 15, plural holes 1a—1a are provided in the permanent magnet 1. By attaching a chain 7 to the male fastener member A, the construction can be used as a key holder and the like. An adhesive tape 8 provided on the female fastener member B makes it possible to attach the fastener to any surface.

Figure 16:
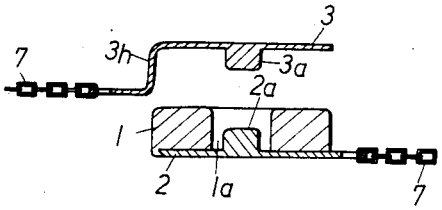
FIG. 16 is a view similar to FIG. 1 of a still further embodiment of the invention.

The embodiment shown in FIG. 16 has only one hole 1a in a permanent magnet 1 which is used to engage with the chain 7. It can be used for necklaces, bracelets and belts. The magnetic pole-plate 3 of the male fastener member A is bent to form a portion 3h so that the chains 8, 8 of both the male and female members will be ideally aligned linearly.

Figure 17:
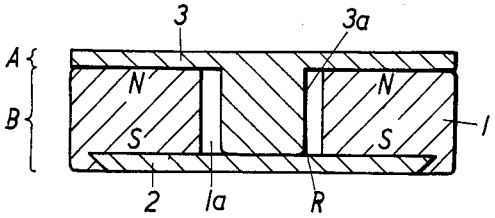
FIGS. 17 and 18 are views similar to FIGS. 1 and 5, respectively, showing a further embodiment of the invention.
Figure 18:
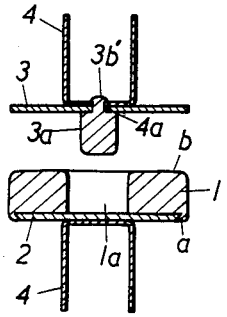

Unlike the fasteners shown in FIGS. 1 through 16, the embodiment shown in FIGS. 17 and 18 has no projection 2a on the magnetic pole plate 2. The projection 3a of the plate 3 is therefore designed longer for the length of hole 1a and is made to directly contact with the plate 2. The permanent magnet 1 in the fastener means can be made as thin as 2.5 mm without hampering the secure engagement of the projection 3a with the hole 1a. Fastener means can therefore be made more compact in size.

Figure 19:
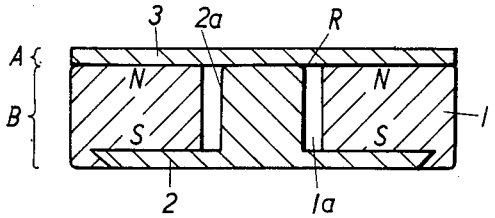
FIGS. 19, 20, 21 and 23 are similar to FIGS. 1 and 5 showing still further embodiments of the invention.
Figure 20:
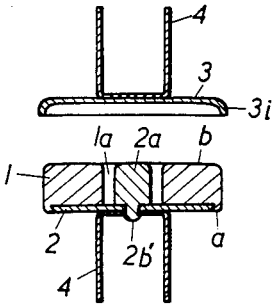

The fastener means shown in FIGS. 19 and 20 has a projection 2a extending as far as the mouth of the hole 1a. The magnetic pole plate 3 has no projection. Since the magnetic flux converges at the top of the projection 2a, the magnetic flux is advantageously prevented from being greatly induced outside. Another advantage of this embodiment is that since there is no projection 3a on the male fastener member A, the magnetic pole b will be protected against scratches. The peripheral edge of the magnetic plate 3 is bent to provide a collar 3i so that the plate 3 will not be displaced from the magnetic pole b.

The features shown in FIGS. 21 through 30 belong to another embodiment of the invention. The object of this embodiment is the provision of raised edge 1b on the periphery of the permanent magnet 1 to surround the pole b. The raised edge 1b can be easily formed since the permanent magnet 1 is made of plastic. The raised edge 1b has unique functions because of its magnetic flux and the configuration. For one, as the magnet 1 itself is highly reluctant material when compared with a ferromagnetic plate, the magnetic flux is generated between the poles a and b and the magnetic flux in the brim edge becomes extremely small. This can be understood from the fact that about 500 gauss of magnetism is measured at the brim edge when the magnetism between the poles a and b of a permanent magnet 1 having a thickness of 4 mm and a raised brim edge of 1 mm in height is 1200 gauss.

As a result, magnetic cash cards and the like will not come in direct contact with the magnetic pole and will not be destroyed even if contacted with the brim edge 1b. Moreover, since the brim edge 1b surrounds the pole b in a ring form, cash cards and the like will not come in direct contact with the pole b.

The raised edge 1b also holds the magnetic pole plate 3 of the male fastener member A in place. This not only prevents lateral displacement of the magnetic plate 3, but also advantageously reduces the interval between the male and female members when they are magnetically engaged.

Still further, since the magnetic flux in the raised edge 1b is induced in the direction of the magnetic pole plate 3 where the magnetic reluctance is smaller when the male and female fastener members are attracted to each other, the magnetic flux will not leak outside but be converged on the projections 2a and 3a.

It is noted that the peripheral edge of the magnet 1 may be continuously raised to form the brim edge in a continuous ring, or it may be crenellated.

Figure 21:
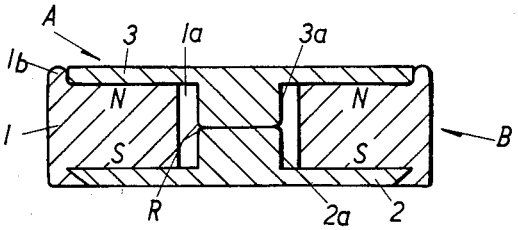
Figure 22:
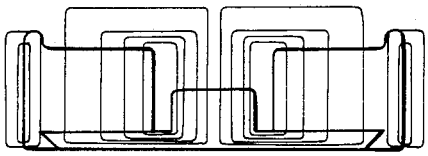
FIGS. 22 is a schematic illustration of magnetic flux for the embodiments of FIGS. 21 and 23.
Figure 23:
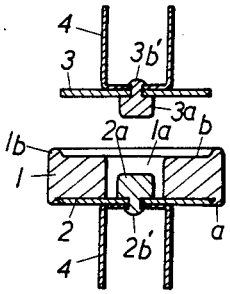
Figure 24:
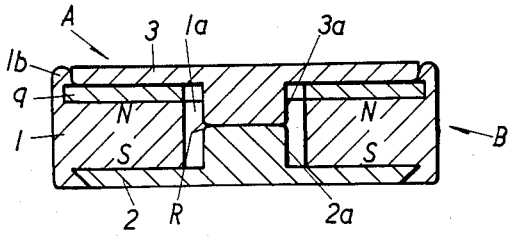
FIGS. 24 and 26 are views similar to FIGS. 1 and 5, respectively, showing a further embodiment of the invention.
Figure 26:
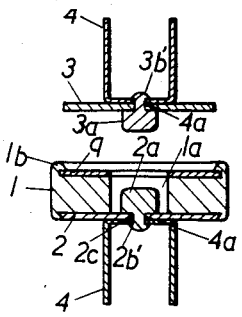
Figure 25:
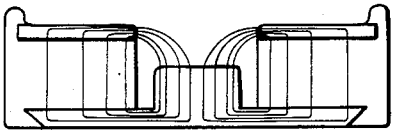
FIG. 25 is a schematic illustration similar to FIG. 2 showing magnetic flux in the embodiment of FIGS. 24 and 26.
Figure 29:
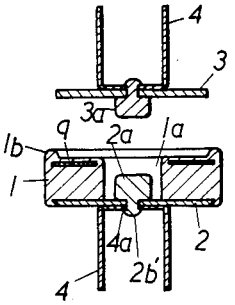
FIGS. 27 and 29 are views similar to FIGS. 1 and 5, respectively, showing a still further embodiment of the invention.

The fastener means shown in FIGS. 24 through 26 is another embodiment of the as shown in FIGS. 21–23 invention. A ferromagnetic shielding plate 9 is molded in the permanent magnet 1 at the pole b. The raised edge 1b is raised above the shielding plate 9. As a result, the magnetic flux of the magnetic pole b is converged on the shielding plate 9, while at the same time, the magnetic flux of the edge 1b will also be attracted to the plate, causing no leakage of the magnetic force. The amount of magnetism at the edge 1b was measured to be about 350 gauss (under the above mentioned conditions). Thus, the magnetic recording portion of a cash card and the like can be further prevented from damage.

Figure 27:
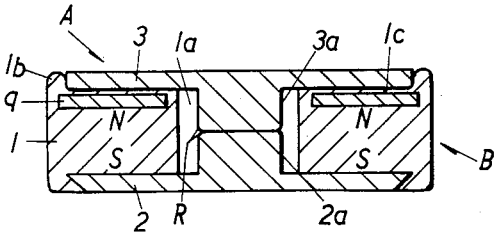
Figure 28:
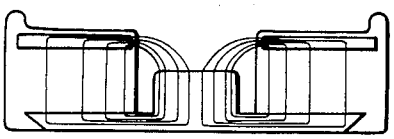
FIG. 28 is a schematic illustration similar to FIG. 2 showing the magnetic flux in the embodiment of FIGS. 27 and 29.

The fastener means shown in FIGS. 27 through 289 is a further embodiment wherein shielding plate 9 is slightly embedded in the permanent magnet 1. This construction allows formation of a layer 1c of the permanent magnet 1 having a high magnetic reluctance. The magnetic flux of the magnet 1 is converged on the shielding plate 9 to constitute a magnetic field of the pole b, so that the amount of magnetic force on the upper surface of the layer 1c tends to be about 350 gaus (under the above conditions). However, since the magnetic flux passing through the plates 2 and 3 of the male and female fastener members to be converged on the projections 2a and 3a will pass through the projections 2a and 3a via the shielding plate 9 (FIG. 28); the attraction will not be decreased.

Thus, even if magnetic cards such as cash cards come in direct contact with the surface of the permanent magnet 1, the magnetically recorded data on the card will not be destroyed.

The invention as shown in FIGS. 21 through 29 may be modified in various ways like the first invention shown in the earlier figures. For example, the projections 2a and 3a may be provided on either one of the male or the female fastener members, or they may be integrally or separately formed from the magnetic plates 2 and 3. A detailed explanation is omitted here to avoid duplication.

I claim:

1. In a magnetic fastener including a permanent magnet member having first and second sides of opposite polarity, a first magnetic pole plate attached against the first side of the magnet member and a second magnetic pole plate removably attachable on the second side of the magnet member, the pole plates being magnetically attracted to the magnet member and to each other through the magnet member, the improvement wherein:

said permanent magnet member comprises a dispersion of hard magnetic powder in a matrix of synthetic resin; and said first magnetic pole plate is integrally attached to said permanent magnet member by said permanent magnet member itself.

2. A magnetic fastener as claimed in claim 1 wherein:

said first magnetic pole plate is at least partly incorporated in said magnetic member.

3. A magnetic fastener as claimed in claim 2 and further comprising:

A hole through said permanent magnet member extending between the first and second sides; and projections on said first and second magnetic pole plates extending into said hole, said projections being magnetically attracted to each other and to the corresponding pole plate.

4. A magnetic fastener as claimed in claim 3 wherein:

said second magnetic pole plate is attachable in direct contact with said second side of said permanent magnet member.

5. A magnetic fastener as claimed in claim 4 and further comprising:

a raised edge surrounding the magnetic pole on said second side of said permanent magnet member forming a rim so that said second magnetic pole plate is located within said rim when attached to said second side.

6. A magnetic fastener as claimed in claim 4 wherein:

said first magnetic pole plate is at least partly embedded in said permanent magnet member so that a thin layer of the permanent magnet member is provided between said first side and said first magnetic pole plate.

7. A magnetic fastener as claimed in claim 4 wherein:

said first pole plate has a chamfered peripheral edge having a chamfered surface facing substantially outwardly of said first side; and a portion of said permanent magnet member at a peripheral edge thereof at said first side overlies said chamfered surface.

8. A magnetic fastener as claimed in claim 1 and further comprising:

a hole through said permanent magnet member extending between the first and second sides; and projections on said first and second magnetic pole plates extending into said hole, said projections being magnetically attracted to each other and to the corresponding pole plate.

9. A magnetic fastener as claimed in claim 1 wherein:

said second magnetic pole plate is attachable in direct contact with said second side of said permanent magnet member.

10. A magnetic fastener as claimed in claim 1 and further comprising:

a raised edge surrounding the magnetic pole on said second side of said permanent magnet member forming a rim so that said second magnetic pole plate is located within said rim when attached to said second side.

11. A magnetic fastener as claimed in claim 1 wherein:

said first magnetic pole plate is at least partly embedded in said permanent magnet member so that a thin layer of the permanent magnet member is provided between said first side and said first magnetic pole plate.

12. A magnetic fastener as claimed in claim 1 wherein:

said first pole plate has a chamfered peripheral edge having a chamfered surface facing substantially outwardly of said first side; and a portion of said permanent magnet member at a peripheral edge thereof at said first side overlies said chamfered surface.

13. In a magnetic fastener including a permanent magnet member having first and second sides of opposite polarity, a first magnetic pole plate attached against the first side of the magnet member and a second magnetic pole plate removably attachable on the second side of the magnet member, the pole plates being magnetically attracted to the magnet member and to each other through the magnet member; the improvement wherein:

said permanent magnet member comprises a dispersion of hard magnetic powder in a matrix of synthetic resin;

said first magnetic pole plate is integrally attached to said permanent magnet member by said permanent magnet member itself; and a magnetic shielding plate attached to the second side of said permanent magnet member for attracting magnetic flux at the pole adjacent said second side.

14. A magnetic fastener as claimed in claim 13 and further comprising:

a raised edge surrounding the magnetic pole on said second side of said permanent magnet member forming a rim so that said second magnetic pole plate is located within said rim when attached to said second side.

15. A magnetic fastener as claimed in claim 14 wherein:

said magnetic shielding plate is attached to said second side by said rim; and said rim projects outwardly from said second side a greater distance than said magnetic shielding plate.

16. A magnetic fastener as claimed in claim 14 wherein:

said magnetic shielding plate is attached to said second side by side rim;

said rim projects outwardly from said second side a distance greater than said magnetic shielding plate;

said first magnetic pole plate is at least partly incorporated in said magnetic member;

said second magnetic pole plate is attachable in direct contact with said second side of said permanent magnet member; and further comprising a hole through said permanent magnet member extending between the first and second sides; and projections on said first and second magnetic pole plates extending into said hole, said projections being magnetically attracted to each other and to the corresponding pole plate.

17. In a magnetic fastener including a permanent magnet member having first and second sides of opposite polarity, a first magnetic pole plate attached against the first side of the magnet member and a second magnetic pole plate removably attachable on the second side of the magnetic member, the pole plates being magnetically attracted to the magnet member and to each other through the magnet member, the improvement wherein:

said permanent magnet member comprises a dispersion of hard magnetic powder in a matrix of synthetic resin;

said first magnetic pole is integrally attached to said permanent magnet member by said permanent magnet member itself; and further comprising a magnetic shielding plate embedded in said permanent magnet member adjacent said second side thereof for attracting magnetic flux at the pole at said second side; and a thin layer formed by a portion of the permanent magnet member between said second side and said shielding plate.

18. A magnetic fastener as claimed in claim 17 and further comprising:

a raised edge surrounding the magnetic pole on said second side of said permanent magnet member forming a rim so that said second magnetic pole plate is located within said rim when attached to said second side.

19. A magnetic fastener as claimed in claim 18 wherein:

said rim projects outwardly from said second side a greater distance than said magnetic shielding plate.

20. In a magnetic fastener including a permanent magnet member having first and second sides of opposite polarity, a first magnetic pole plate attached against the first side of the magnet member and a second magnetic pole plate removably attachable on the second side of the magnet member, the pole plates being magnetically attracted to the magnet member and to each other through the magnet member, the improvement wherein:

said permanent magnet member comprises a dispersion of hard magnetic powder in a matrix of synthetic resin;

said first magnetic pole plate is at least partly incorporated in said permanent magnetic member;

said second magnetic pole plate is attachable in direct contact with said second side of said permanent magnet member; and further comprising a magnetic shielding plate embedded in said permanent magnet member adjacent said second side thereof for attracting magnetic flux at the pole at said second side;

a thin layer formed by a portion of the permanent magnet member between said second side and said shielding plate;

a hole through said permanent magnet member extending between the first and second sides; and projections on said first and second magnetic pole plates extending into said hole, said projections being magnetically attracted to each other and to the corresponding pole plate.

* * * * *